US007387303B1

(12) United States Patent
Spillman et al.

(10) Patent No.: US 7,387,303 B1
(45) Date of Patent: Jun. 17, 2008

(54) SPINNER FOR A ROLLER SKATE

(76) Inventors: Jeanne L Spillman, 1316 S. Ironwood Dr., South Bend, IN (US) 46544; Thimothy A Abbott, 6133 Marshall Rd., Centerville, OH (US) 45459

( * ) Notice: Subject to any disclaimer, the term of this patent is extended or adjusted under 35 U.S.C. 154(b) by 303 days.

(21) Appl. No.: 11/164,046

(22) Filed: Nov. 8, 2005

(51) Int. Cl.
*A63C 17/22* (2006.01)

(52) U.S. Cl. ..... 280/11.19; 280/809; 40/587; 301/37.25; 301/5.301

(58) Field of Classification Search ..... 280/11.19, 280/11.227, 809; 40/587; 301/37.25, 5.301
See application file for complete search history.

(56) References Cited

U.S. PATENT DOCUMENTS

| | | | | |
|---|---|---|---|---|
| 2,997,344 | A * | 8/1961 | Whiteman | 301/37.25 |
| 4,929,030 | A * | 5/1990 | Park | 301/37.25 |
| 5,659,989 | A * | 8/1997 | Hsiao et al. | 40/587 |
| 6,554,370 | B2 * | 4/2003 | Fowlkes | 301/37.25 |
| 6,592,189 | B1 | 7/2003 | Back | |
| 6,619,758 | B1 | 9/2003 | Ross | |
| 6,702,396 | B1 * | 3/2004 | Wang | 301/37.25 |
| 6,799,810 | B1 * | 10/2004 | Wang | 301/37.25 |
| 6,874,941 | B2 | 4/2005 | Egeraat | |
| 6,964,454 | B1 * | 11/2005 | Miansian et al. | 301/37.25 |
| 7,100,995 | B2 * | 9/2006 | Gilly et al. | 301/37.25 |
| 7,210,747 | B1 * | 5/2007 | Spillman et al. | 301/37.25 |
| 2005/0067880 | A1 * | 3/2005 | Buhler et al. | 301/37.35 |
| 2005/0116530 | A1 * | 6/2005 | Simpson | 301/37.25 |

* cited by examiner

*Primary Examiner*—Christopher Ellis
*Assistant Examiner*—John D Walters
(74) *Attorney, Agent, or Firm*—Leo H. McCormick

(57) ABSTRACT

A spinner apparatus retained on a wheel to change and enhance the appearance of a roller skate. The spinner apparatus includes a support member connected to the wheel by first and second leg passing through spokes in the hub and resiliently positioned adjacent the outer face of the wheel. The support member has a plurality of radial slots that extend from adjacent an axial opening that receives an axial projection on a disc to position the disc in a plane adjacent the outer face of the wheel. The support member rotates with the wheel while the disc independently rotates in the axial opening of the support member and as a result any light that passes through the first and second plurality of slots is interrupted to illustrate a difference in the rotation of the wheel and disc.

5 Claims, 2 Drawing Sheets

SPINNER FOR A ROLLER SKATE

This invention relates to a spinner apparatus that is attached to the wheel of a roller skate.

BACKGROUND OF THE INVENTION

The wheels of a roller skate are attached to an axle through the engagement of a bearing by a nut that is affixed by threads to the axle. The type of material used in a wheel is normally determined by the surface on which a person will skate however most wheels are made from plastic such as the wheel disclosed in U.S. Pat. No. 6,592,189. In all roller skates, the material in the wheels or the bearing eventually wears requiring the replacement thereof by removing the nut from the axle. In order to enhance the appearance of a roller skate, wheels have been made of various colors that can often be selected to match an outfit of a skater. The roller skates function in an adequate manner but often a person may desire to have an appearance different from that of other skaters.

In co-pending patent application Ser. No. 10/907,809 structure is provided to provide a spinner apparatus that enhances the wheel of a roller skate. This structure is attached to the wheel through a cone member that is retained on the axle by a same nut that holds the bearing against the hub of the wheel. While this structure accomplishes a goal of enhancing a wheel, any time a person desires to change the spinner the nut must be removed from the axle.

SUMMARY OF THE INVENTION

The present invention provides a spinner apparatus that is easily attached to the wheel of a roller skate that may be removed and replaced without disassembling the wheel from an axle.

In more particular detail, the spinner apparatus includes a support member and disc that are attached to a hub of a wheel such that the support freely rotates with the hub while disc may independently on the support member. The support member is distinguisher by an annular base with an axial opening therein, a first plurality of radial slots that extend from an arcuate rib adjacent the axial opening to a rim adjacent a peripheral surface and first and second axial legs that extend from the annular base. The first axial leg has an end with a first radial opening therein while the second axial leg has an end with a second radial therein opening adjacent a second end thereof with the first and second legs extending through corresponding openings in the hub of the wheel. A clip has a first end located in the first radial opening in the first leg and a second end located in the second radial opening in the second leg to connect the support member to the hub. A spring that is located between the bearing and the annular base resiliently positions the annular base adjacent an outer face of the wheel. The disc has a second plurality of radial slots therein that extend from a first location adjacent a center axial projection to a second location adjacent a second rim on its peripheral surface. The center axial projection has a radial slot that extends from an end thereon toward the disc such that when inserted into the axial opening in the support member the arcuate rib thereon is located in a groove on the axial projection. The disc is free to rotate with respect to the support member while the support member rotates with the wheel and as a result the transmission of light between the wheel and a viewer is interrupted by the first and second plurality of radial slots to illustrate a difference in the rotation of the wheel with respect to the disc.

An advantage of the invention occurs in an ability to easily change the appearance of a roller skate through the addition of a disc that is free to rotate to the wheel.

The present invention provides an enhanced appearance without affecting the functional movement of a wheel on a bearing of a roller skate.

DETAILED DESCRIPTION OF THE INVENTION

In the various embodiments of the invention, a same component is identified by a same member.

Figure 1:
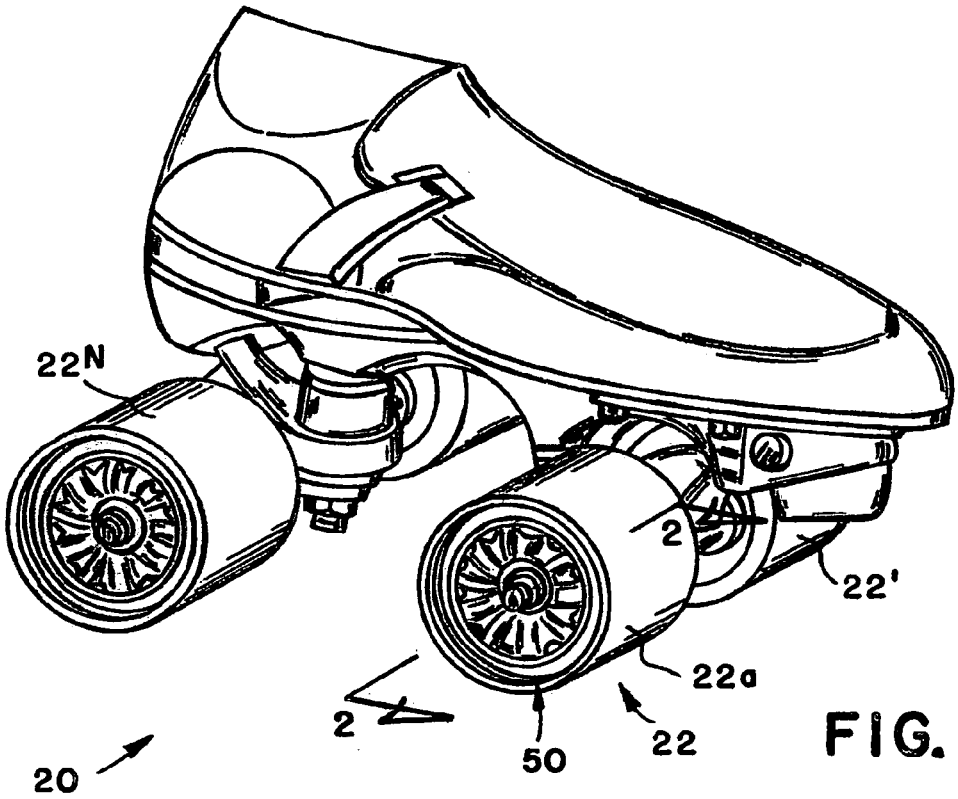
FIG. 1 is a roller skate having a spinner apparatus of the present invention attached to a wheel thereof.
Figure 2:
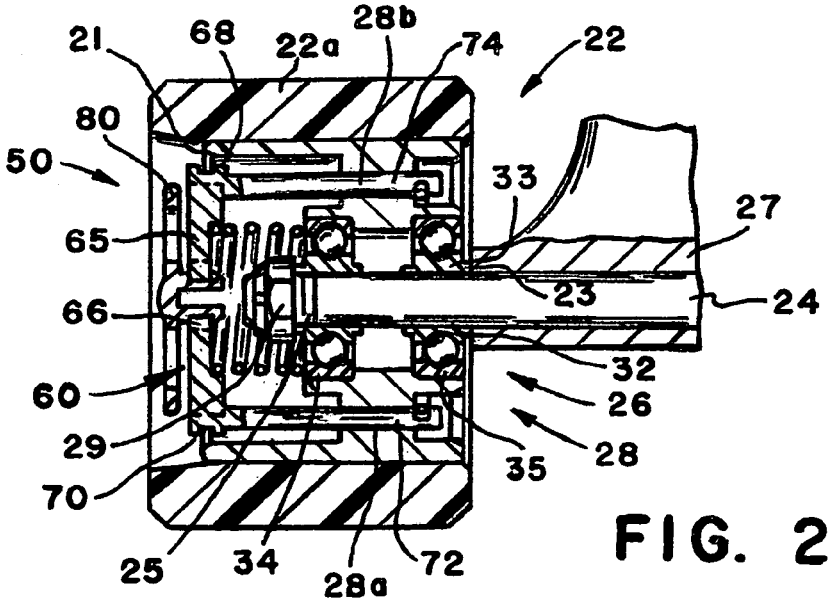
FIG. 2 is a sectional view taken along lines 2-2 of FIG. 1.

A roller skate 20 as shown in FIG. 1 has a spinner arrangement 50 of present invention attached to each wheel and bearing assembly 22, 22' . . . 22$^n$ to enhance the appearance of the roller skate 20. Wheel and bearing assemblies 22, 22' are attached to a front axle 24 of the roller skate 20 as illustrated in FIG. 2 for wheel and bearing assembly 22 while wheel and bearing assemblies 22" and 22$^n$ are attached to a rear axle (not shown).

Each wheel and bearing assembly 22, 22' . . . 22$^n$ for the roller skate 20 is identical and the description hereinafter equally applied to each assembly. Wheel and bearing assembly 22 is defined by a wheel **22*a* and a bearing 26 as illustrated in FIG. 2 where bearing 26 has an inner race 32 and outer race 34 that are pressed onto a hub 28 of the wheel 22*a* such that the bearing 26 and wheel 22*a* rotate on an axle 24 that extends from a truck 27 for the roller skate 20. The wheel and bearing assembly 22 is retained on axle 24 by screwing a nut 29 onto threads 25 of the axle 24 such that a cup 33 of the inner race 32 and a cup 35 of the outer race 34 are urged against and aligned with a shoulder 23 on the axle 24. The level of torque applied to screw nut 29 onto threads 25 of axle 24 and urge the cup 33 and cup 35 against shoulder 23 affects the rotational ease of a wheel 22*a* on the axle 24. Once a desired ease of rotation is achieved it is desirable not to have to remove the wheel 22*a* as the desired torque would have to be reapplied to reset the desired frictional resistance. The spinner arrangement 50 of the present invention may be attached to, removed from and changed with respect to a wheel 20*a* without the removal a wheel nut 29 from an axle 24 and as a result a desired frictional relationship is not affected through the addition of a spinner arrangement 50 to a wheel. When a wheel and bearing assembly 22 rotates, this rotation is directly applied to the support member 60 of the spinner arrangement 50 while a disc 80 is free to independently rotate on the support member 60 to modify the reflection of light between the wheel 22*a* and a viewer to emphasize a difference in the rotation of the spinner arrangement 50 and the wheel 22*a***.

Figure 3:
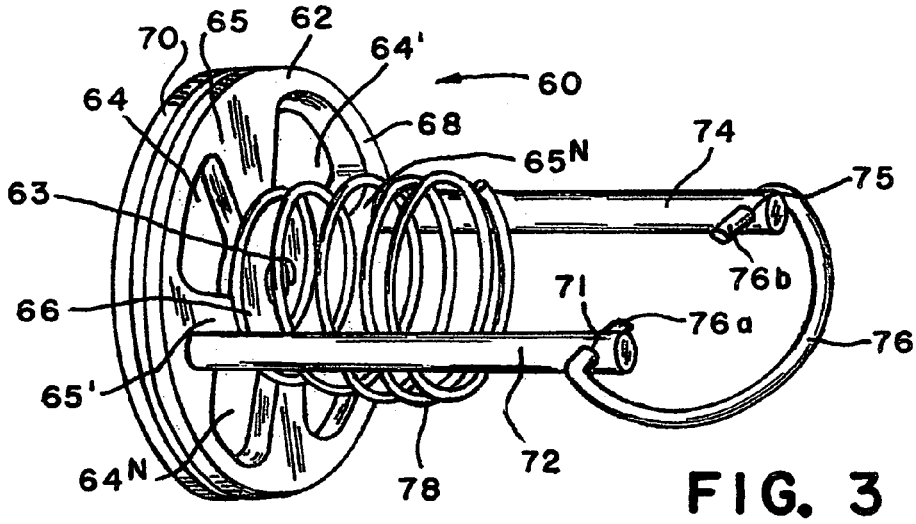
FIG. 3 is a perspective view of the support member for the spinner apparatus of FIG. 1.

A spinner arrangement 50 is attached to each wheel **22*a*, 22*a*' . . . 22$^n$, each spinner arrangement is identical and includes a support member 60 and a disc 80. The support member 60 is shown in more detail in FIG. 3 while the disc 80 is shown in more detail in FIGS. 4 and 5. The support member 60 rotates with each wheel 22***a*, 22*a*' . . . 22$^n$ while the disc 80 is free to independently rotate with respect to the support member 60 to illustrate a difference in rotation of the disc 80 and each wheel 22*a*, 22*a*' . . . 22$^n$.

The support member 60 has an annular base 62 with an axial opening 63, a first plurality of radial slots 64, 64' . . . 64$^n$ therein the extend from a first location adjacent annular rib or hub 66 surrounding the axial opening 63 to a second location or rim 68 on its peripheral surface 70 to define a first plurality of radial spokes 65, 65' . . . 65$^n$. The radial spokes 65, 65' . . . 65$^n$ have an ornamental shape defined by a triangle with an apex adjacent the hub 66 and a base adjacent the rim 68. The support member 60 further includes first 72 and second 74 axial legs that extend from the annular base 62 with axial leg 72 having a first radial opening 71 adjacent a first end thereof and the second axial leg 74 having a second radial opening 75 adjacent a second end thereof. The first leg 72 and the second leg 74 are designed to extending through corresponding axial openings 28*a*, 28*b* in the hub 28 of the wheel 22*a*. Hub 28 is shown in FIG. 2 as being a solid disc but most often would be defined by spokes and the openings would be the space between the spokes.

The support member 60 is retained in hub 28 by a clip 76 that has a first end 76*a* located in radial opening 71 of the first leg 72 and a second end 76*b* located in radial opening 75 of the second leg 74. A spring 78 that is located between bearing 26 and the annular base 62 acts on the support member 60 urges clip 76 into engagement with the hub 28 to position the annular base 62 adjacent an outer face 21 on wheel 22*a*.

Figure 4:
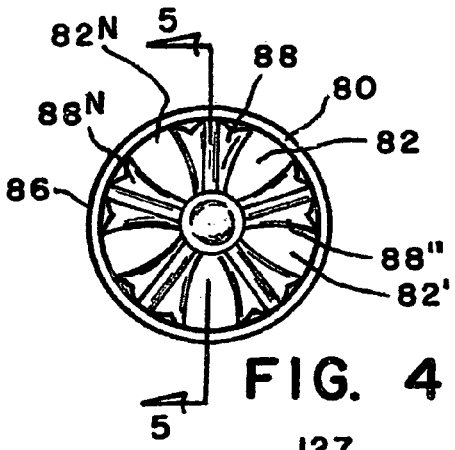
FIG. 4 is an elevation of a disc for the spinner apparatus of FIG. 1.
Figure 5:
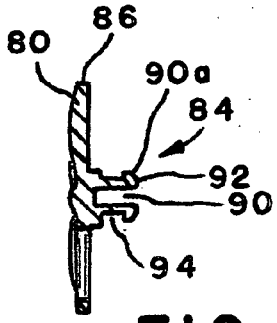
FIG. 5 is a sectional view taken along lines 5-5 of FIG. 4.

The disc 80 has a second plurality of radial slots 82, 82' . . . 82$^n$ therein that extend from a first location adjacent a center annular axial projection 84 to a second location or rim 86 adjacent its peripheral surface to define a second plurality of radial spokes 88, 88' . . . 88$^n$. The radial spokes or fins 88, 88' . . . 88$^n$, each have an ornamental shape that is best shown in FIG. 4 having a triangle with an apex adjacent the axial projection 84 and a base on rim 86. The radial spokes or fins 88, 88' . . . 88$^n$ are coated with a reflective material to enhance their appearance. The center axial projection 84 has a radial slot 90 that extends from an end 92 thereon toward the disc 80 and a groove 94 located between the end 92 and the disc 80. The end 90 has an annular tapered surface 90*a* and is inserted into axial opening 63 in the support member 60 such that the central hub 66 on the support member is positioned in groove 94. There is a gap between the central hub 66 and the groove 94 and as a result disc 80 is free to rotate with respect to the support member 60.

Figure 6:
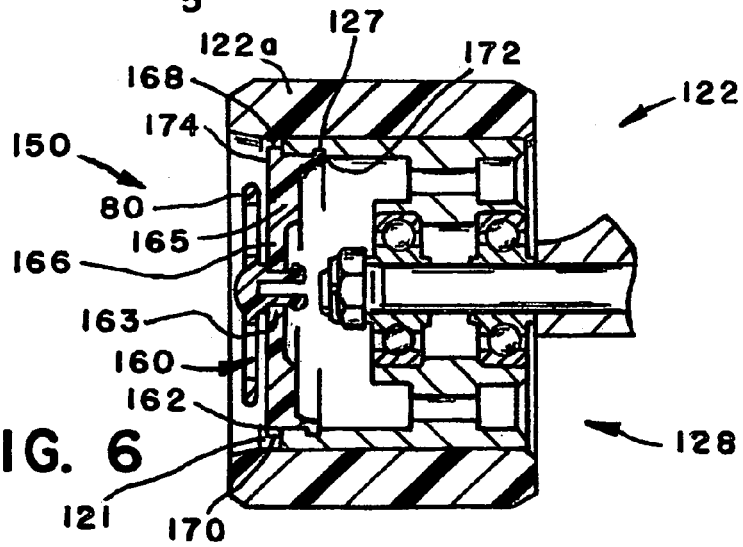
FIG. 6 is a sectional view of a second embodiment of a spinner apparatus for use in a roller skate.

A second embodiment of a spinner arrangement 150 for a wheel 122*a* is illustrated in FIG. 6 and differs in that the support member 160 is resiliently attached to the hub 128 through a groove 127. Support member 160 has an annular base 162 with an axial opening 163 with a plurality of radial slots therein to define a first plurality of radial spokes 165, 165' . . . 165$^n$ therein the extend from a first location adjacent annular rib or hub 166 surrounding the axial opening 163 to a second location or rim 168 on its peripheral surface 170. The radial spokes 165, 165' . . . 165$^n$, each have an ornamental shape with an apex adjacent the hub 166 and a base on rim 168 similar to that of support member 60 shown in FIG. 3. The rim 168 of the support member 160 has a radial rib 172 on a first side and a radial flange 174 on a second side. The radial rib 172 is located in groove 127 in the hub 128 of the wheel 122*a* while radial flange 174 engages an annular face on the hub 128 to position the support member 160 adjacent an outer face 121 of the wheel 122*a*. As with the support member 60, disc 80 is attached to support member 160 in a same manner in that axial projection 84 extends through axial opening 163 and with hub 166 located in a groove 94, disc 80 is free to rotate with respect to the support member 160.

MODE OF OPERATION

The wheel and bearing assemblies 22, 22' . . . 22$^n$ of a roller skate 20 rotate as a person moves from one location to another location. The spinner apparatus 50, 150 in each of the embodiments function in a same manner in that support member 60,160 is fixed to hub 28,128 and as a result rotates with a same number of revolutions as the wheel 22*a*, 122*a* while disc 80 is free to rotate in hub 66,166 of a support member 60,160 as a function of the frictional engagement of groove 94 in the axial projection 84 with the hub 66,166. While disc 80 may in actuality rotate at a lesser speed when the wheel 22*a* is rotating it may continue to rotate after a wheel 22*a* stops rotating as a function of inertia. A person viewing the rotation of disc 80 and the rotation of a wheel 22*a*, 22*a*' . . . 22$^n$ is provided with an illusion that a wheel may be rotating at a faster rate than is actually occurring since the transmission of light between a wheel and a viewer is interrupted or changed by the reflection of the surfaces on the first 65, 65' . . . 65$^n$ and second 88, 88' . . . 88$^n$ radial spokes. Thus the addition of a spinner apparatus 50,150 may enhance the appearance of the roller skate 20.

What is claimed is:

1. In a roller skate having an axle with a bearing and wheel retained thereon by a nut such that the wheel freely rotates on the axle, a spinner apparatus secured to the wheel to enhance the appearance of the wheel comprising:

a support member having an annular base with an axial opening therein, a first plurality of radial slots therein the extend from a first location adjacent said axial opening to a second location adjacent a peripheral surface and first and second axial legs that extend from the annular base with the first axial leg having a first radial opening adjacent a first end thereof and the second axial leg having a second radial opening adjacent a second end thereof, said first leg and said second leg extending through corresponding axial openings in the hub of the wheel;

a clip having a first end located in said first radial opening in said first leg and a second end located in said second radial opening in said second leg;

a spring located between the bearing and said annular base to position said annular base adjacent an outer face of the wheel; and a disc having a second plurality of radial slots therein that extend from a first location adjacent a center axial projection to a second location adjacent its peripheral surface, said center axial projection having a radial slot that extends from an end thereon toward the disc, said center axial projection having a groove located between said end and said disc such that on insertion of said center axial projection into said axial opening in said support member said annular base is positioned in said groove, said disc being free to rotate with respect to said support member while said support member rotates with the wheel to interrupt the transmission of light between the wheel and a viewer through the first and second plurality of radial slots to illustrate a difference in the rotation of the wheel with respect to the disc.

2. The roller skate as recited in claim 1 wherein said second plurality of radial slots in said disc define a plurality of fins that respond to air flow to assist in independently rotating said disc with respect to said wheel.

3. The roller skate as recited in claim 2 wherein each of said plurality of fins is adorned with a reflective coating.

4. The roller skate as recited in claim 1 wherein said spring urges said clip into engagement with the hub of the wheel in positioning said support member adjacent face of the wheel.

5. The roller skate as recited in claim 4 wherein said spring absorb any axially force applied to said disc by allowing said support member to axially move with respect to the hub to prevent damaging the disc.

* * * * *